US006431233B1

(12) United States Patent
Malkoff

(10) Patent No.: US 6,431,233 B1
(45) **Date of Patent: *Aug. 13, 2002**

(54) GOLF CLUB COVER

(76) Inventor: Abe A. Malkoff, 2482 Barth Dr., Youngstown, OH (US) 44505

( * ) Notice: Subject to any disclaimer, the term of this patent is extended or adjusted under 35 U.S.C. 154(b) by 0 days.

This patent is subject to a terminal disclaimer.

(21) Appl. No.: 09/723,382

(22) Filed: Nov. 28, 2000

Related U.S. Application Data

(63) Continuation-in-part of application No. 09/408,896, filed on Sep. 29, 1999, now Pat. No. 6,193,063, which is a continuation-in-part of application No. 09/173,431, filed on Oct. 15, 1998, now abandoned.

(51) Int. Cl.[7] ..... A63B 55/00
(52) U.S. Cl. ..... 150/160; 206/315.2
(58) Field of Search ..... 206/315.2, 315.3; 150/159, 160, 154

(56) References Cited

U.S. PATENT DOCUMENTS

| | | | | |
|---|---|---|---|---|
| 1,886,464 A | | 11/1932 | Bright | |
| 2,014,589 A | | 9/1935 | Saad | |
| 2,705,039 A | | 3/1955 | Halter | |
| 2,879,819 A | | 3/1959 | Turnbull | |
| 3,606,325 A | | 9/1971 | Lamkin et al. | |
| 3,965,955 A | | 6/1976 | Price | |
| 4,368,768 A | * | 1/1983 | Cunko, Jr. | 150/160 |
| D279,448 S | | 7/1985 | Thawley et al. | |
| 5,005,624 A | | 4/1991 | Sung | |
| 5,145,171 A | | 9/1992 | Head et al. | |
| 5,168,909 A | | 12/1992 | Joyner, Jr. | |
| 5,284,194 A | | 2/1994 | Gaffney | |
| 5,325,986 A | | 7/1994 | Richardson et al. | |
| 5,345,987 A | | 9/1994 | Hagar | |
| 5,437,320 A | | 8/1995 | Sung | |
| 5,547,193 A | | 8/1996 | Sander | |
| D374,051 S | | 9/1996 | Sheppard, Jr. | |
| 5,553,733 A | | 9/1996 | Rosenthal | |
| D393,893 S | | 4/1998 | Pollard | |
| 6,044,880 A | * | 4/2000 | Maeng | 150/160 |
| 6,193,063 B1 | * | 2/2001 | Malkoff | 206/315.2 |

* cited by examiner

*Primary Examiner*—Lee Young
*Assistant Examiner*—Tri M. Mai
(74) *Attorney, Agent, or Firm*—Robert J. Herberger

(57) ABSTRACT

A golf club protective cover which provides a semi-rigid upper enclosure to protect the club head and a sock-like lower enclosure attached to the upper enclosure for protection of the club shaft. The upper enclosure is formed as a semi-rigid cylinder and has an elongated opening in the side wall of the upper enclosure so that the club may be inserted into the cover from the top through the elongated opening or through the bottom of the lower enclosure in a conventional manner.

12 Claims, 8 Drawing Sheets

GOLF CLUB COVER

This application is a continuation-in-part of the application having Ser. No. 09/408,896 filed Sep. 29, 1999, now U.S. Pat. No. 6,193,062 which is a continuation-in-part of the parent application having Ser. No. 09/173,431 filed Oct. 15, 1998, now abandoned.

FIELD OF THE INVENTION

This invention relates in general to protective covers for golf clubs and in particular, to such covers which protect the head and shaft of the clubs when they are used during play of the game or are being shipped or stored. This invention also provides a protective cover which allows the club to be inserted into the cover in two separate ways; either from the bottom of the cover or by means of an access opening in the upper portion of the cover.

BACKGROUND OF THE INVENTION

Recent developments in golf club designs have made the protection of golf clubs when not in use more important than in the past. For example, the introduction of the graphite shaft to replace the traditional steel shaft has made protection of the shaft important. When these clubs are in the golf bag and transported during the game, the shafts tend to rub against the edge of the bag or against the partitions in the bag used to separate various groups of clubs. This rubbing on the bag can abrade a "rub ring" on the shaft which first causes cosmetic damage but which can, after time, cause physical damage to the shaft. Also the use of more exotic metals for the club heads, especially the "woods" such as the driver and long fairway clubs, has made protection of the club head equally important.

To provide this protection, long tubular sleeves often referred to as "socks" are known to protect the shafts in the bag and large soft bulbous head covers are attached to the top of the "socks." It is often difficult to thread the club head through this narrow "sock," especially when the head of the club is oversized, which is popular today.

To thread the club head through the narrow tubular sleeve of the "sock," the club shaft is often rested on the ground while the club is held vertical. The head of the club is then threaded through the sock opening into the head cover. However, if the grass is wet or the ground is damp or muddy, the shaft grip, resting on the ground, becomes wet, slippery and/or contaminated with dirt or other abrasives which often interfere with a firm and comfortable grip of the golfer. Also, the moisture and contaminates often accelerate degradation and deterioration of the shaft grip.

Additionally, if the head of the club has acquired soil or other contaminates during use, these abrasive elements can be trapped in the shaft "sock" and will further add to the frictional damage acquired as discussed above.

It would therefore be desirable to have a protective cover for today's golf clubs that could be used to overcome and avoid the noted difficulties.

SUMMARY OF THE INVENTION

The present invention overcomes the difficulties and disadvantages of the prior art by providing a golf club cover which not only protects the shaft and club head but also provides a flexible sleeve member, to protect the shaft, attached to a semi-rigid head cover. The head cover has a reinforced opening in the side wall so that the club may be inserted into the top of the cover. The semi-rigid head cover keeps the side wall opening readily accessible and also provides additional protection from damage by the bag rim or adjacent clubs during play and shipping.

The present invention also comprises a flexible sleeve member with an opening so that the club can be easily removed from the cover by pulling the flexible sleeve portion over the club head, or the cover can be easily placed on the golf club head by sliding the cover down over the club, thereby providing the more standard means of application as an alternative, when weather and course conditions permit.

BRIEF DESCRIPTION OF THE DRAWINGS

Eleven figures have been selected to illustrate a preferred embodiment of the present invention.

DETAILED DESCRIPTION OF THE PREFERRED EMBODIMENT

Figure 1:
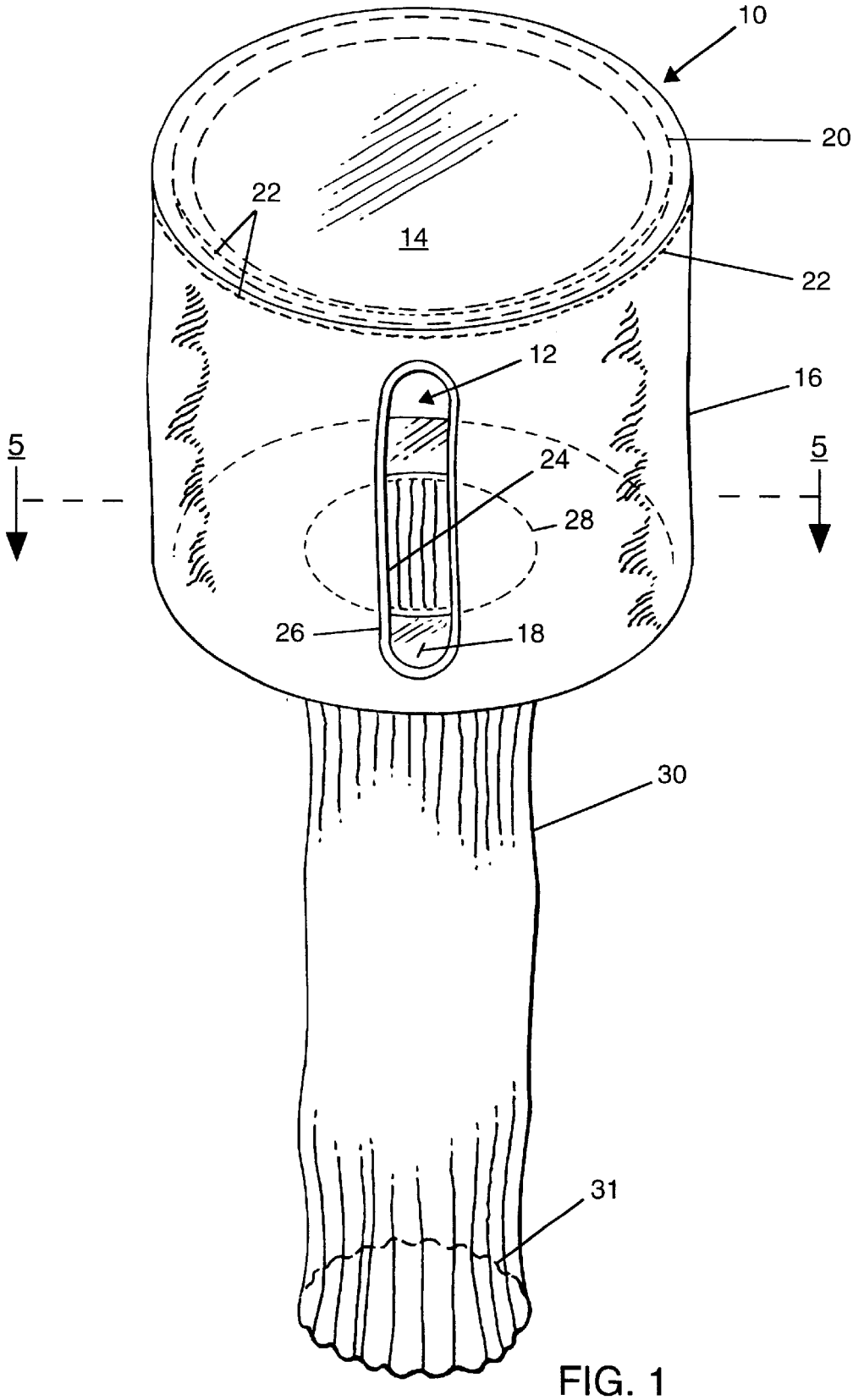
FIG. 1 is a perspective view of the cover of the present invention.
Figure 2:
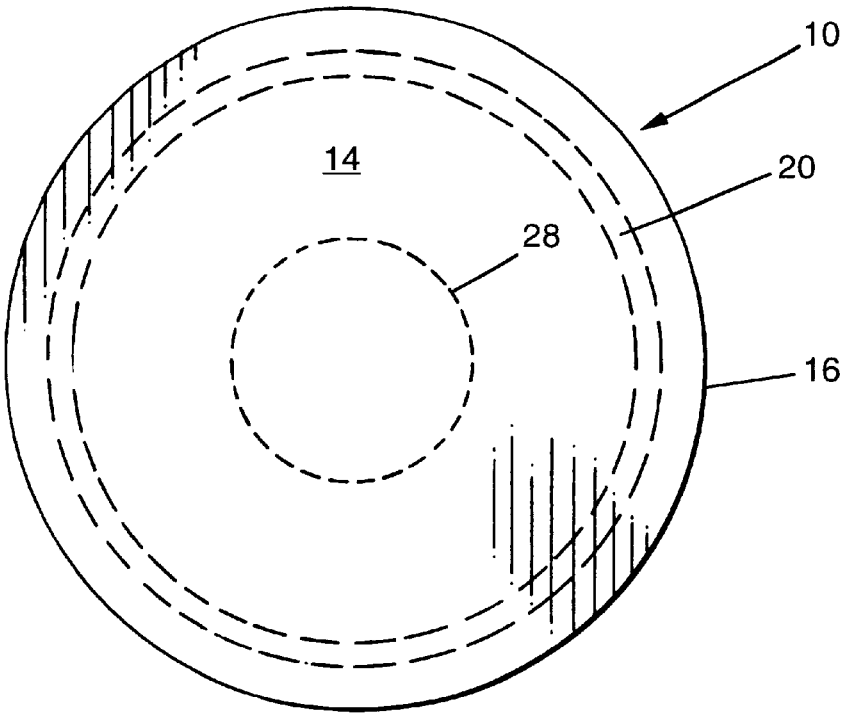
FIG. 2 is a top plan view of the cover.
Figure 3:
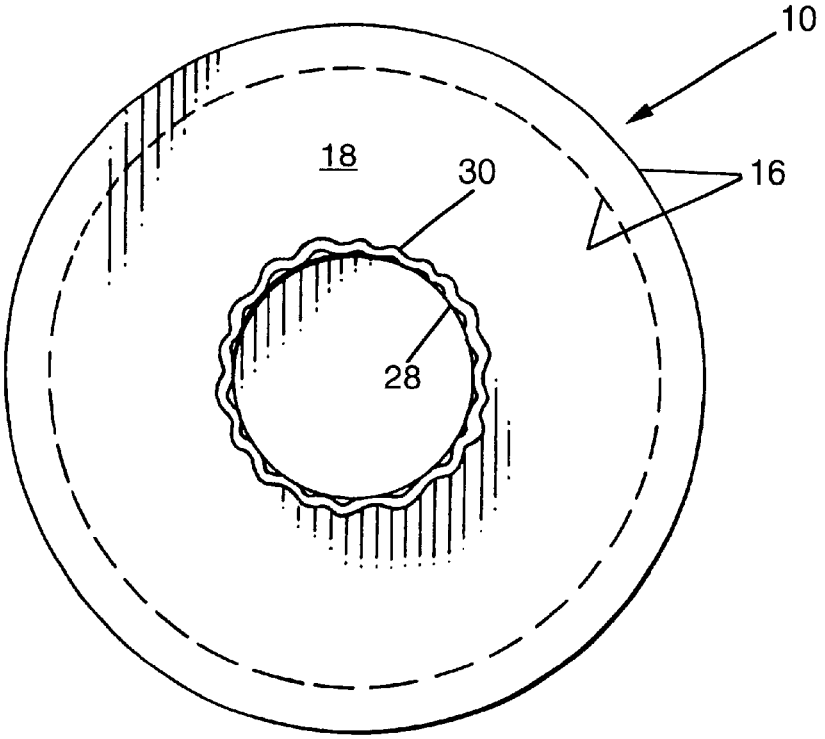
FIG. 3 is a bottom plan view of the cover.
Figure 4:
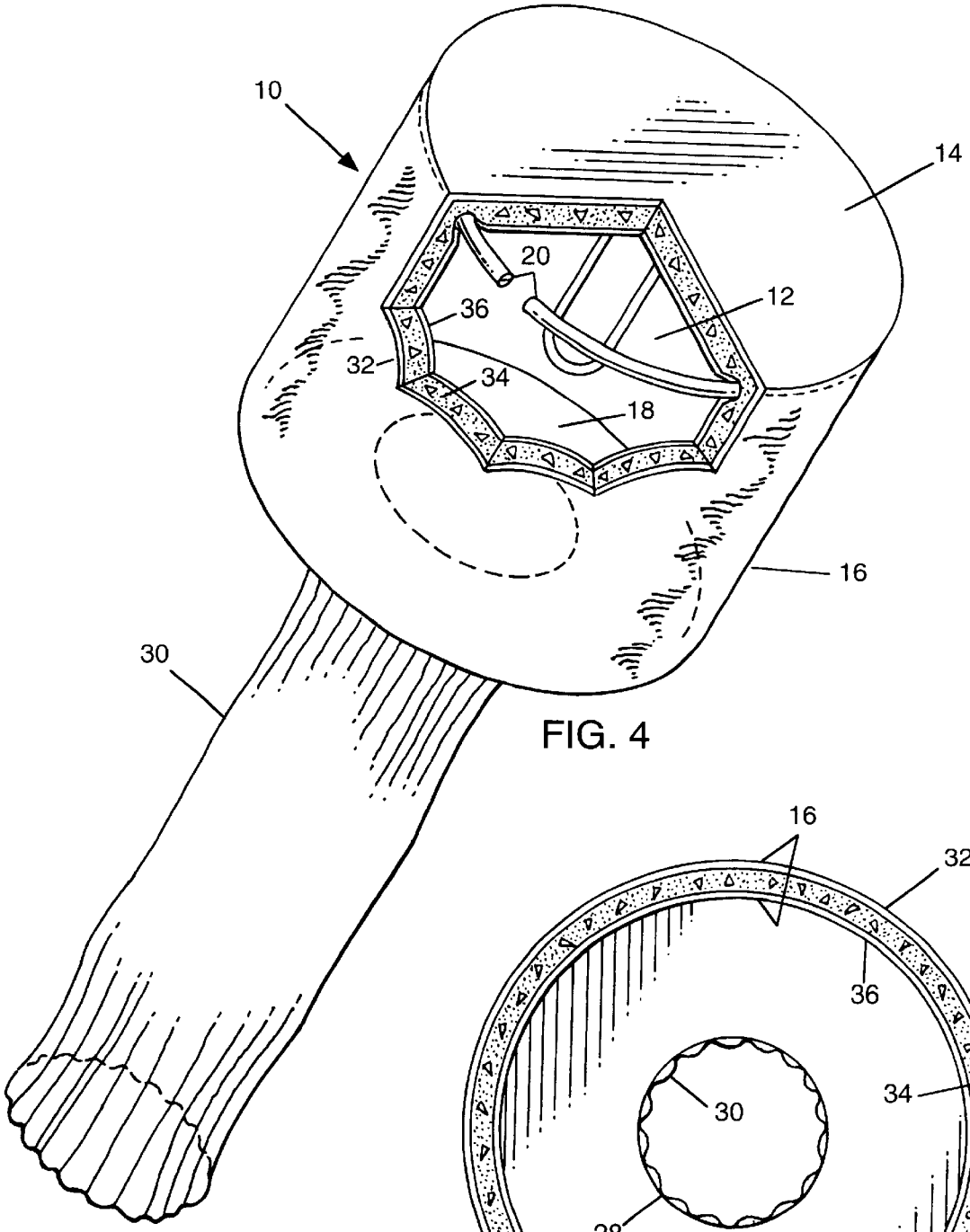
FIG. 4 is a perspective view showing by partial cutaway the wall structure and a circular rigid member.
Figure 5:
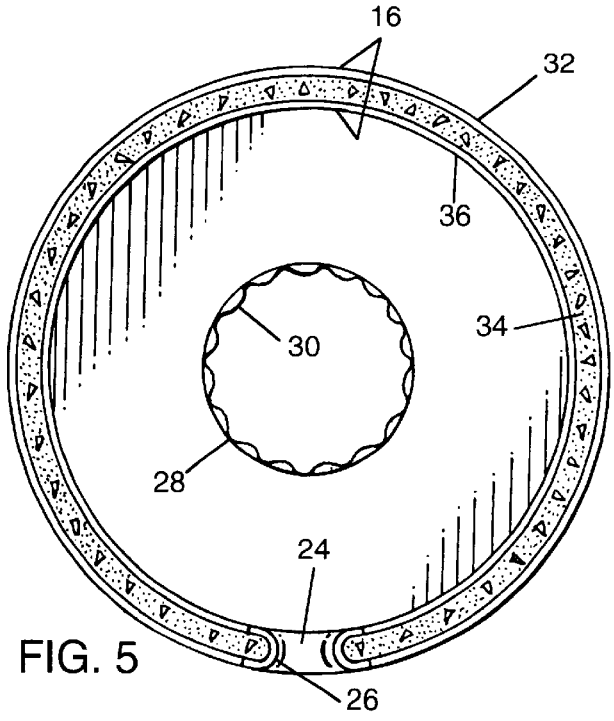
FIG. 5 is a sectional view taken along line 5—5 of FIG. 1.

Referring first to FIG. 1, a perspective view of the cover assembly 10 is shown. An upper enclosure 12 (first enclosure) is formed by a top wall 14, a cylindrical side wall 16 and a bottom wall 18. Around the upper edge of the top wall 14 at the junction with the side wall 16, as best seen in FIG. 4, there is provided a circular rigid member 20 which can be a stiff wire member or similar material to provide rigidity to the assembly. In the first embodiment, the rigid member 20 is incorporated into a stitching 22, shown in broken lines in FIG. 1, which binds the top wall 14 to the side wall 16. The bottom wall 18 is stitched to the side wall 16 thus forming the cylindrical pocket, or upper enclosure 12, for the club head.

Figure 8:
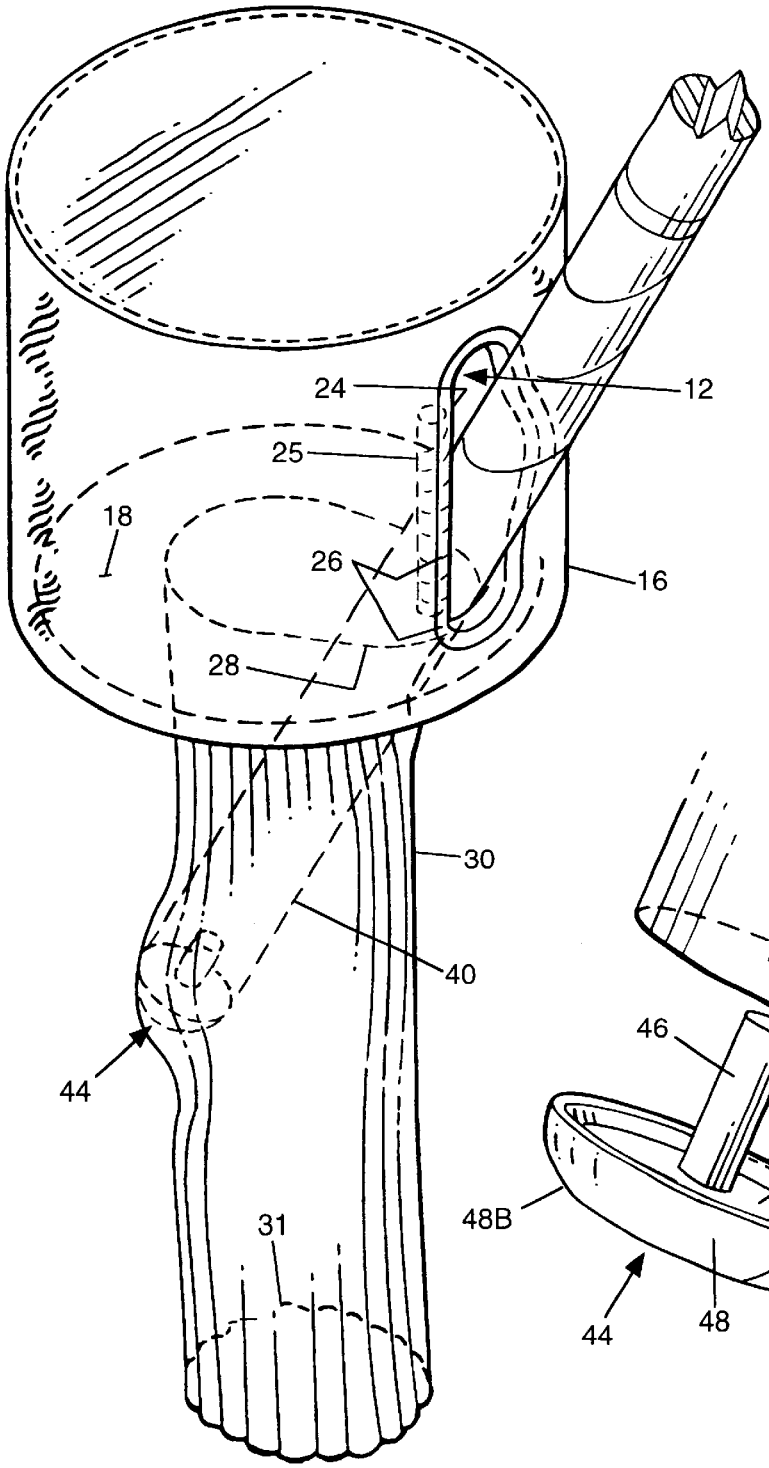
FIG. 8 is a perspective view showing insertion of a shaft of a club into the top of the cover displaying by partial cutaway the reinforcement of the opening in the top of the cover.

In the side wall 16 there is provided an elongated, substantially vertical opening 24 for receiving the distal end of the club shaft 40 when the club is inserted into the cover. Although the length of the opening 24 may vary, in the preferred embodiment, the length is approximately 4 to 6 inches to accommodate the various sizes of golf club heads 42. Preferably, the length of the opening is around 5 inches. In order to protect the edges of the opening 24 from abrasion damage, a stitch binding 26 is applied around the opening edge. The stitch binding 26 may be elastic to provide additional flexibility, however, elastic binding is not essential. An elongated support member 25 is stitched along one side of the opening 24 to provide firmness, as shown in FIG. 8, so that the opening 24 remains permanently elongated for easier access of the club in and out of the cover 10. The elongated support member 25 is preferably a flexible plastic, although it may be metal. Since the material of the side wall 16, elongated support member 25 and stitch binding 26 is elastic and/or flexible, the opening 24 can be pulled open, then stretched via the elastic and unreinforced side of the opening, which is opposite the side of the opening 24 having the elongated support member 25, to admit the club head 42 into the pocket 12. The bottom wall 18 is provided with a stretchable central opening 28 for receiving one end of a lower enclosure 30 (second enclosure).

The lower enclosure 30 is made of a flexible and elastic material and forms a sock-like enclosure for a portion of the club shaft. In the preferred embodiment, the flexible material used to form the lower enclosure 30 is knitted and attaches directly to the bottom portion of cylindrical side wall 16. Due to the elasticity of said knitted material, the material substantially contracts inward thereby forming bottom wall 18 and central opening 28, which then leads into lower enclosure 30. The opposite end of the lower enclosure 30 has a stretchable opening 31. As an alternative design, an end of the lower enclosure 30 is attached by stitching, or other known fastening means, to the bottom wall 18 at the central opening 28. In the alternative design, bottom wall 18 attached to side wall 16 is a flexible material separate from the knitted material forming lower enclosure 30.

Referring now to FIG. 4, there is shown in a partial cutaway view, the details of construction of the upper enclosure 12. The walls 14 and 16 are comprised of a three layer assembly. An outer layer 32 is selected for a pleasing appearance and may, for example, be of a synthetic fur material, preferably waterproof. A center layer 34 is a reinforcing layer made of foam or similar material and contributes to the rigidity of the cover. An inner layer 36 is of a soft, elastic cloth material chosen to protect the finish of the club head 42 during storage. As discussed above, there is provided at the junction of the top wall 14 and the side wall 16, the rigid member 20 being a stiffening wire. This wire, in combination with the reinforcing layer 34, maintain the upper enclosure 12 in a semi-rigid cylindrical form.

Figure 6:
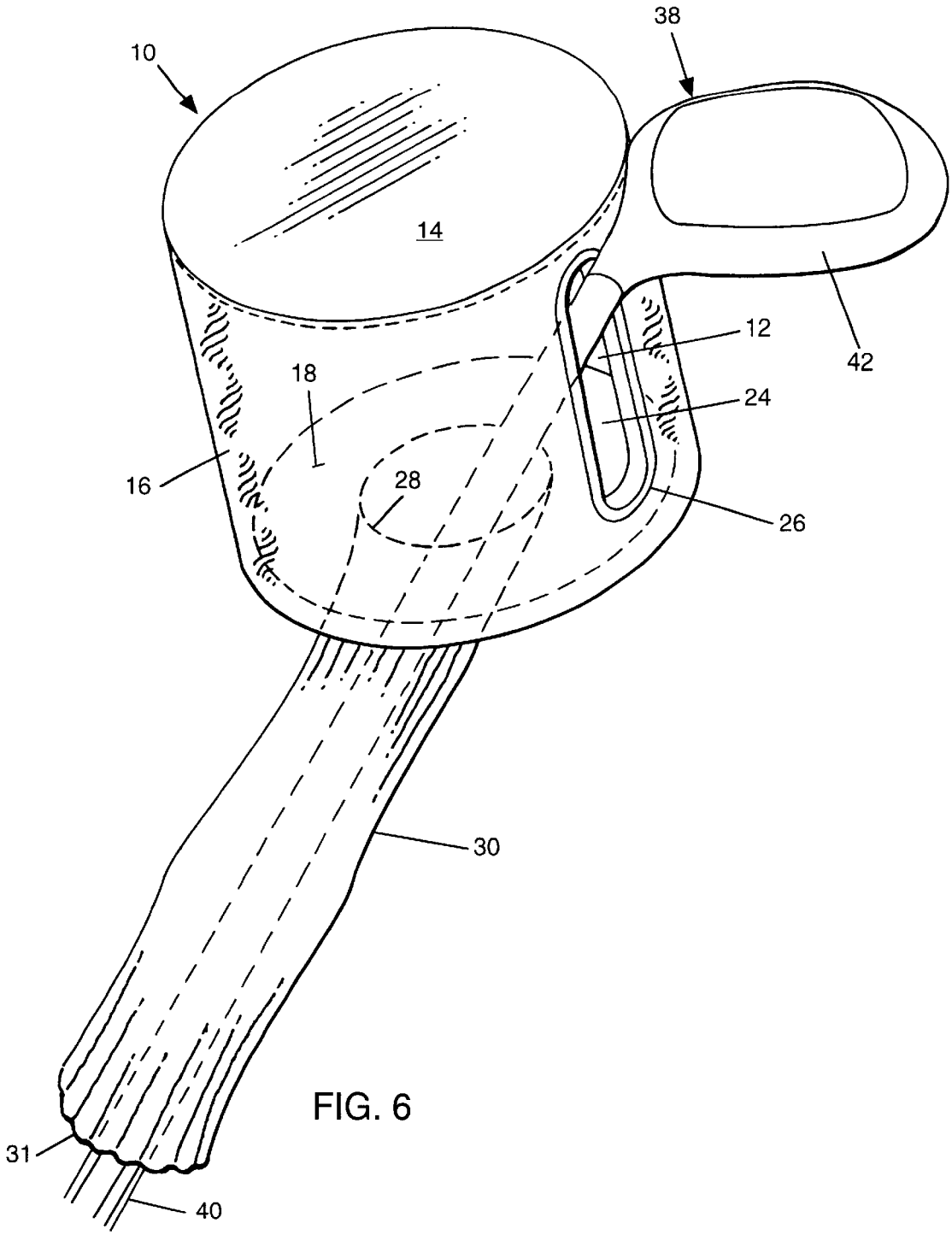
FIG. 6 is a perspective view showing insertion of a club into the top of the cover.
Figure 7:
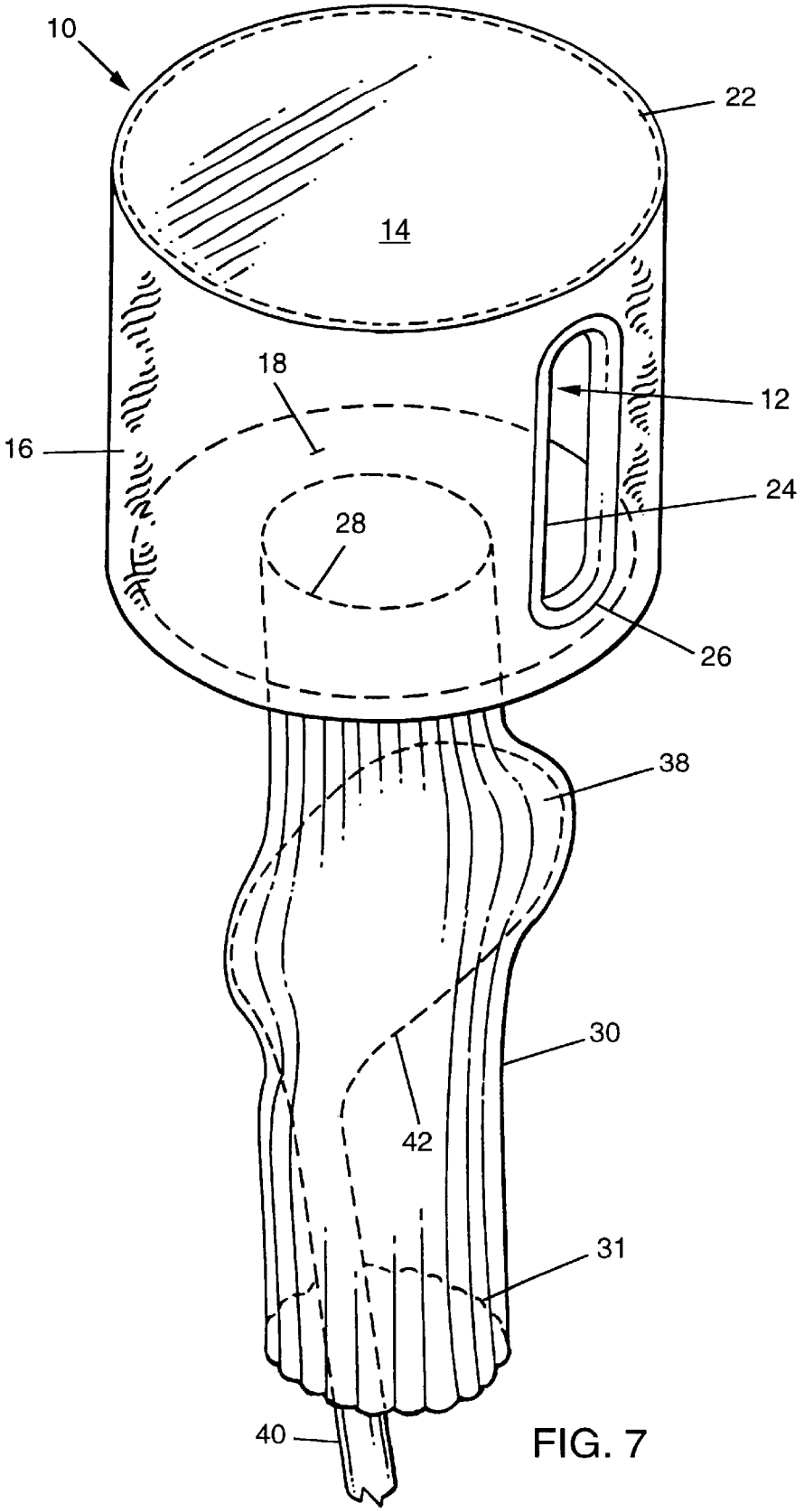
FIG. 7 is a perspective view showing removal of a golf club through the bottom of the sleeve.

FIGS. 6, 7 and 8 illustrate the ways in which the invention may be used. In FIG. 6, the golf club 38 is shown being inserted into the cover 10 through the upper enclosure 12. In this mode, the distal end of the club shaft 40 is inserted into the opening 24 and then through the stretchable hole 28 in the bottom wall 18 of the upper enclosure 12. The shaft then is slipped through the lower enclosure 30 and the club head 42 is pushed through the flexible and stretchable opening 24 into the pocket 12. In FIG. 7, insertion or removal of the golf club from the open end of the lower enclosure is demonstrated. Here, for insertion for example, the club head 42 is inserted into the bottom opening 31 of the lower enclosure 30. The club head 42 is then pushed through the lower stretchable opening 28 into the bottom wall 18 and up into the pocket 12 in the conventional manner. The club head is removed through the lower enclosure 30 in reverse fashion.

Figure 9:
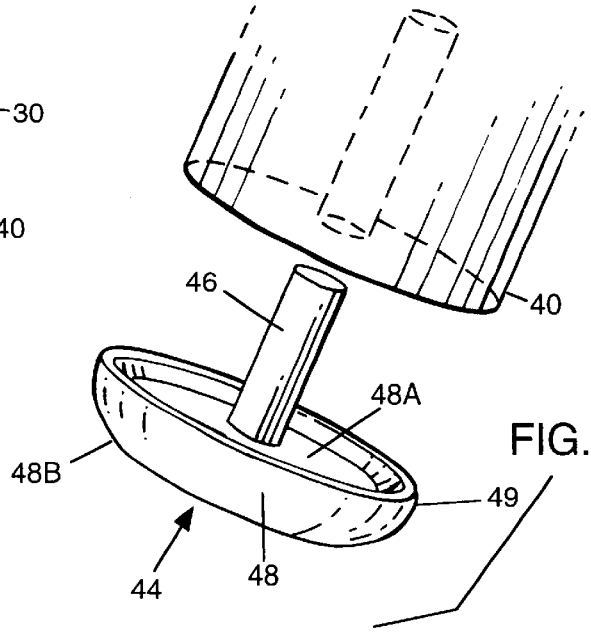
FIG. 9 is perspective exploded view of a shaft end-cap attached at the distal end of the golf club shaft.

More specifically describing the mode of use whereby the distal end of the shaft 40 is inserted into the cover through the upper enclosure 12, an end-cap 44 shown in FIG. 9 is inserted in the distal end of the shaft 40 to protect the shaft but, more importantly, to reduce friction when the club shaft 40 is inserted through opening 24 and then through the lower enclosure 30. The end-cap 44 has a cylindrical stem 46 having a diameter slightly larger than the diameter of an opening common at the distal end of the club shaft 40. The preferred length and diameter of the cylindrical stem 46 is 19 mm and 3 mm, respectfully. Referring to FIGS. 8 and 9, the end-cap 44 is attached to the distal end of the club shaft 40 at a concave inner side 48A of an end-disk 48. The concaved shape of the end-disk 48 allows for a close fit of the end-cap 44 over the distal end of the golf club shaft 40. The outer surface 48B of the end-disk 48 has an outermost preferred diameter of 28 mm so that it slightly overlaps, passes around and over the top of the shaft's distal end via a rounded edge 49. The top of the outer surface 48B is flat and smooth and the rounded edge 49 of the end-disk 48 is also relatively unabrasive. The rounded edge 49 makes a smooth and more gradual transition between the top of the outer surface 48B of the end cap 44 and the side of the distal end of the club shaft 40, as opposed to the sharper turned edge of a typical club. Without the end-cap, it was found that the shaft of the club often snagged the elastic material. The end cap 44 is therefore needed to protect the cover, especially the bottom wall 18 of the upper enclosure 12 and the knitted, elastic sock-like lower enclosure 30, from being snagged, stretched and ripped by the distal end of the club shaft 40. Also, the shaft 40 of the golf club can stress, become distorted, and possibly break, if snagged aggressively. The end cap 44 also serves to protect the distal end of the club shaft 40 from dirt and moisture.

Figure 10:
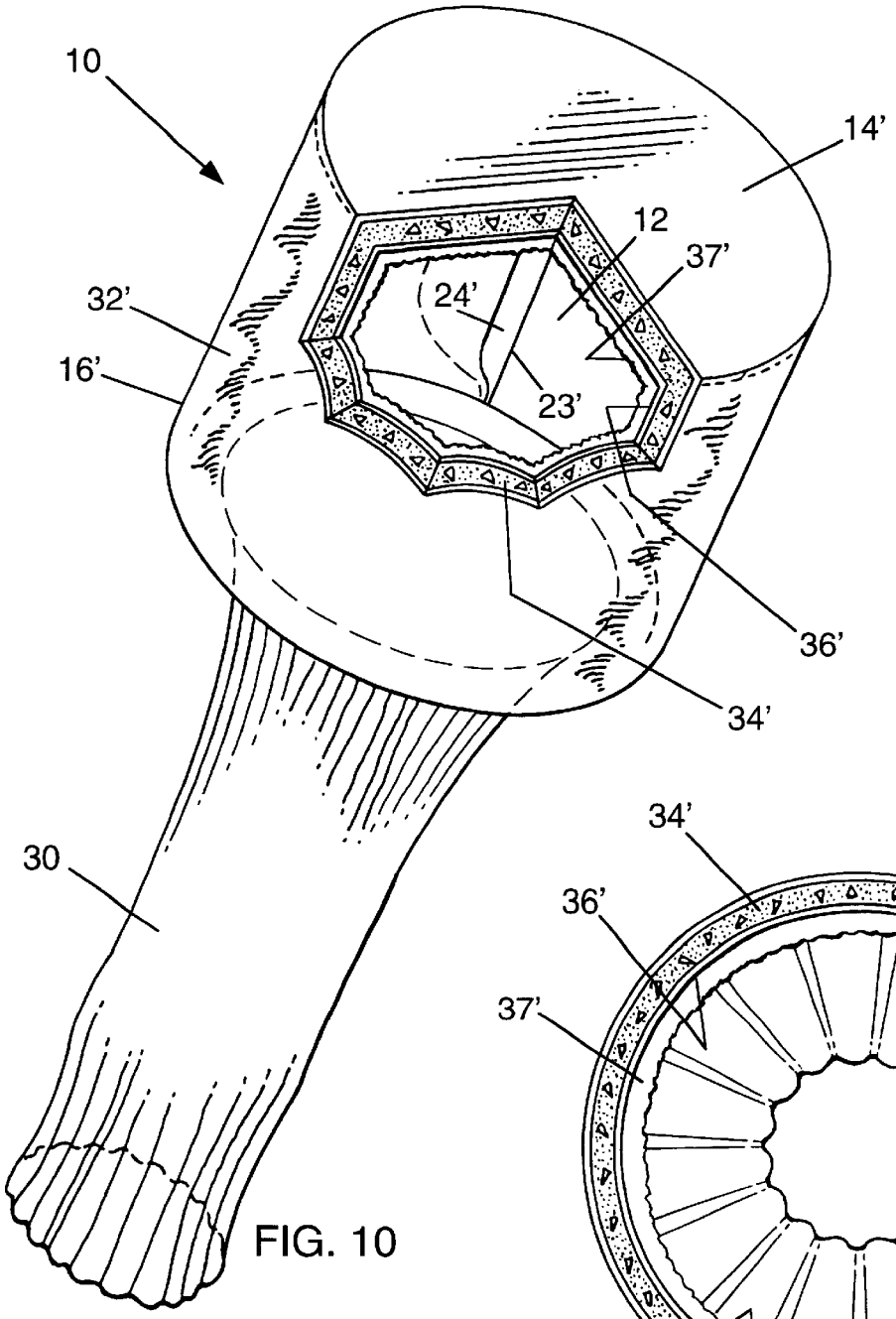
FIG. 10 is a perspective view of the second embodiment of the cover showing a partial cutaway of the wall structure with multi-layered materials.
Figure 11:
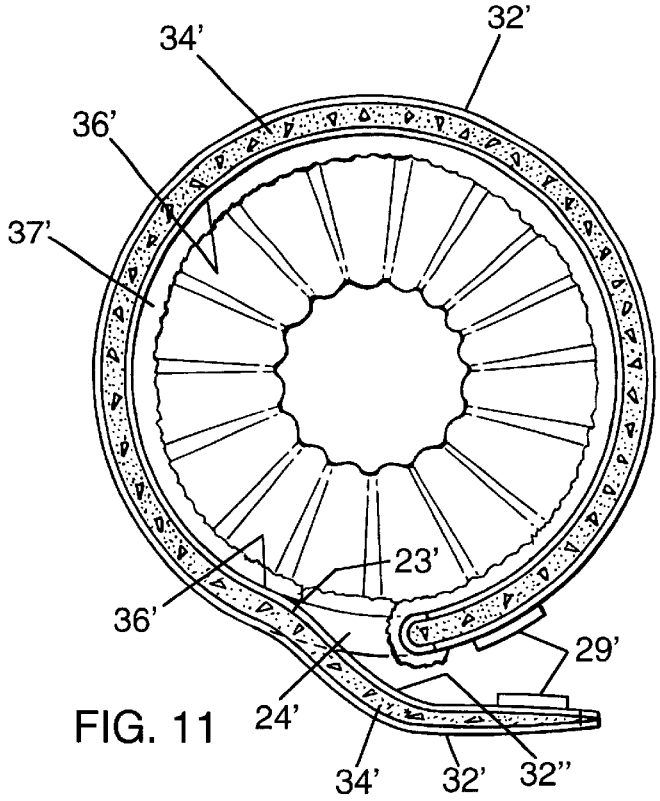
FIG. 11 is a sectional view taken along line 11—11 of FIG. 12 showing the multi-layered materials of the second embodiment.

As an alternative to the first embodiment having end cap 44, rigid member 20 and elongated support member 25, the golf club cover assembly 10 in a second embodiment eliminates these elements and includes walls 14' and 16' comprised of four layers. Viewing FIGS. 10 through 12, the outer layer 32' is a semi-rigid water-proof canvas material being non-elastic. The second embodiment also includes a foam center layer 34' and a net-like layer 36' much like the first embodiment. Further included, however, it is a synthetic fur-like innermost layer 37' being substantially non-abrasive. The fur-like innermost layer 37' is slippery and eliminates friction with the club shaft 40 and head 42, thereby preventing snagging therebetween which is a reason the end cap 44 is required in the first embodiment. Further, it is important to note that the rigidity of the multi-layer construction of the second embodiment allows for the elimination of the circular rigid member 20 described above.

Figure 12:
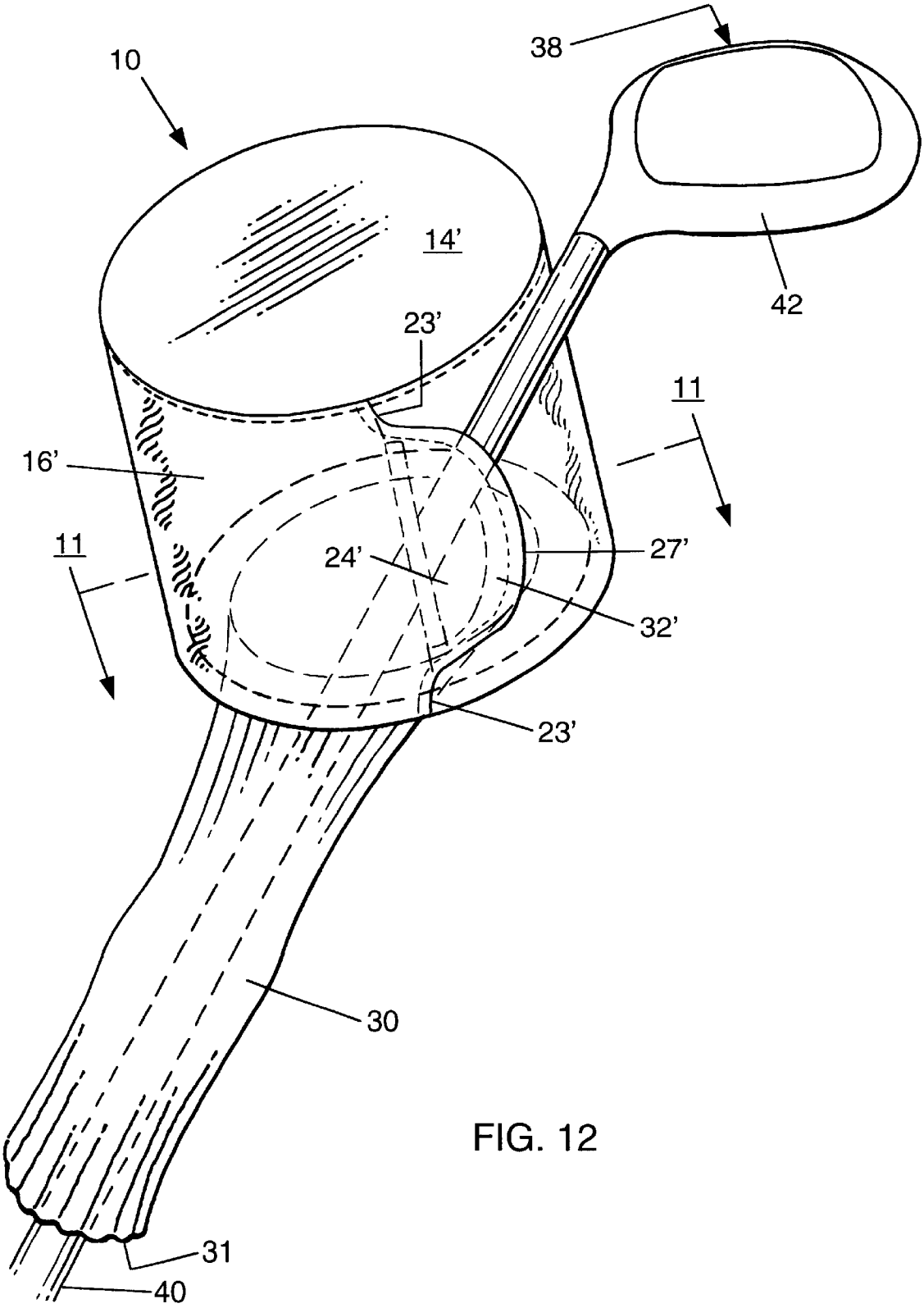
FIG. 12 is a perspective view of a second embodiment of the cover of the present invention showing a open flap and insertion of the club into the top of the cover.

The second embodiment also comprises a flap 27'. The flap 27' is attached to the cylindrical side wall 16' and circumferentially raps over a longitudinal slit-like opening 24' formed along a seam 23' in the side wall 16'. The flap 27' is made of a multi-layer assembly having canvas outer and inner layers 32', 32" with a foam center layer 34', thereby forming a semi-rigid support to keep the opening 24' longitudinally elongated in its natural state. It is important to note that the flap 27' does not include the fur-like innermost layer 37'. The flap 27' overlaps the opening 24' and is secured to the opposite side of the opening by a securing mechanism 29', such as Velcro® or a snap. With the flap 27', there is no need for the opening 24' to be elastic as described in the first embodiment. Instead, the flap 27' naturally closes opening 24' thereby providing a the club cover that effectively keeps the club from exposure therethrough to inclement weather. In use, and as shown in FIG. 12, the flap 27', being made of a semi-rigid canvas material having a memory, is folded back to access the opening 24'. The flap 27' automatically returns to its original shape and closed position when released, thereby firmly closing the opening 24' once the club shaft 40 and club head 42 is passed therethrough.

Thus it can be seen that the present invention described above provides different embodiments of a unique cover for a modern golf club which provides a semi-rigid enclosure for the club head as well as a soft protective sleeve for the fragile shaft. It also provides a unique feature which allows the club to be inserted into the cover through the top end and removed from the cover through the sleeve, thereby preventing contact by the club, and more specifically the hand-grip of the club shaft, with the ground.

What is claimed is:

1. A golf club cover for protecting the head and shaft of a golf club, said cover comprising:

a semi-rigid first enclosure for receiving the head of a golf club, said first enclosure having a top wall, a side wall attached to said top wall forming said first enclosure into a generally cylindrical enclosure having an axis, said side wall having a generally elongated longitudinal opening therein for inserting therethrough the shaft of the golf club and finally the head of the golf club into said first enclosure, the opening having an outer edge with at least two sides;

a semi-rigid flap being made of a foldable material having a memory, the flap being circumferentially attached to the side wall adjacent the opening and along one of the sides of the opening and naturally extending over the opening so that the flap automatically unfolds and covers the opening when the head and shaft of the golf club is not being passed therethrough; and means defining a second enclosure for receiving the shaft of the golf club, said means defining said second enclosure comprising a flexible and elastic sleeve attached at one end to the side wall of said first enclosure and open at the other end for passage therethrough the head and shaft of the golf club from said cover.

2. The golf club cover according to claim 1, wherein said side wall of the said semi-rigid first enclosure comprises a multi-layered construction including an water impervious outer layer and an innermost layer being made of a non-abrasive slippery material.

3. The golf club cover according to claim 2, wherein the elongated longitudinal opening in said first enclosure is narrow and along a seam in the side wall of the first enclosure, and said semi-rigid flap having an inside and an outside with each side comprising a non-stretchable water impervious material, the side wall and inside of said flap having an attachment mechanism to removably secure the flap over the opening to the side wall.

4. The golf club cover according to claim 3, wherein said first enclosure further comprises a stitched seam junction between said top wall and said side wall, the stitched seam junction reinforcing said top wall and said side wall to further support the cylindrical shape of said first enclosure.

5. A golf club cover for protecting the head and shaft of a golf club comprising:

a semi-rigid first enclosure for receiving the head of the golf club, said semi-rigid first enclosure having a top wall, a side wall attached at said top wall forming said first enclosure into a generally cylindrical enclosure, said side wall having an opening therein for inserting therethrough the shaft of the golf club and finally the head of the golf club into said first enclosure, said opening being elongated and having at least two sides;

a second enclosure for receiving the shaft of the golf club, said second enclosure comprising an elongated flexible and elastic sleeve extending at one end from said first enclosure and open at the opposite end of the second enclosure for passage therethrough the head and shaft of the golf club from said cover; and a semi rigid flap being attached to one side of the opening in said first enclosure, said semi rigid flap being made of a foldable material having a memory so that the opening is automatically covered by the flap when the head of the golf club is positioned in the first enclosure.

6. The golf club cover according to claim 5, wherein said side wall of the said semi-rigid first enclosure comprises a multi-layered construction including an water impervious outer layer and a non-abrasive innermost layer having fur-like material with a substantially frictionless texture so that the club may be inserted into the cover without snagging the first enclosure.

7. The golf club cover according to claim 6, wherein said semi-rigid first enclosure has a stitched seam junction between said top wall and said side wall, the stitched seam junction reinforcing the cylindrical shape of said first enclosure.

8. The golf club cover according to claim 6, wherein the opening in said first enclosure is elongated at least four inches and positioned along a seam in the side wall in a longitudinal direction relative to the cylindrical shape of said first enclosure, and the semi-rigid flap supports the longitudinal integrity of said opening.

9. The golf club cover according to claim 8, wherein said semi-rigid flap having at least two sides with each side comprising a non-stretchable water impervious material, the side wall and inside of said flap further having an attachment device to removably secure the flap over the opening and said side wall.

10. The golf club cover protecting the head and shaft of a golf club, said cover comprising:

a first enclosure for receiving the head of the golf club, said first enclosure having a cylindrical shape formed by a side wall and a top wall attached to said side wall, a longitudinal elongated narrow opening along a seam in the side wall for inserting therethrough the shaft of the golf club and finally the head of the golf club into said first enclosure, the opening being at least four inches long having an outer edge with at least two sides, said longitudinally elongated opening being laterally flexible relative to the longitudinal elongated shape so that said opening can be pulled and widened to admit the head of the golf club, a semi rigid flap being attached to one side of the opening, said semi-rigid flap being made of a pliable material having a memory so that the opening is automatically covered by the flap when the head of the golf club is positioned in the first enclosure, the flap rigidity further supporting the longitudinal integrity of said opening so that the opening automatically closes laterally relative to the longitudinal shape of the opening when the head of the golf club is positioned in the first enclosure; and a second enclosure for receiving the shaft of the golf club, said second enclosure comprising an elongated flexible and elastic sleeve extending at one end from the side wall of the first enclosure and having an opening at the opposite end for removing therethrough the head and shaft of the golf club from said cover.

11. The golf club cover according to claim 10, wherein the semi-rigid flap has a canvas outer layer on at least two sides.

12. The golf club cover according to claim 11, wherein the sidewall and top wall have a multi-layered construction including a semi-rigid foam material, a water impervious outer layer and a non-abrasive inner most layer, the inner most layer having a substantially frictionless texture so that the club may be inserted into the cover without snagging the first enclosure.

* * * * *